US008167018B2

(12) United States Patent
Haug

(10) Patent No.: US 8,167,018 B2
(45) Date of Patent: May 1, 2012

(54) DEVICE FOR SEPARATING LABELS STACKED IN A FEEDER

(75) Inventor: Thomas Haug, Langnau im Emmental (CH)

(73) Assignee: Frama AG, Lauperswil (CH)

( * ) Notice: Subject to any disclaimer, the term of this patent is extended or adjusted under 35 U.S.C. 154(b) by 1010 days.

(21) Appl. No.: 11/339,331

(22) Filed: Jan. 24, 2006

(65) Prior Publication Data

US 2006/0191643 A1 Aug. 31, 2006

(30) Foreign Application Priority Data

Jan. 24, 2005 (EP) ..... 05405033

(51) Int. Cl.

| | |
|---|---|
| ***B31F 5/04*** | (2006.01) |
| ***B29C 65/50*** | (2006.01) |
| ***B29C 65/56*** | (2006.01) |
| ***B32B 37/02*** | (2006.01) |
| ***B32B 37/14*** | (2006.01) |
| ***B32B 37/16*** | (2006.01) |
| *B43M 5/00* | (2006.01) |

(52) U.S. Cl. ..... 156/442.2; 156/442; 156/558; 156/563

(58) Field of Classification Search ..... 156/442, 156/442.2, 558, 563, DIG. 29, DIG. 30, DIG. 39, 156/DIG. 42

See application file for complete search history.

(56) References Cited

U.S. PATENT DOCUMENTS

| | | | | |
|---|---|---|---|---|
| 2,262,798 | A * | 11/1941 | Elliott | 156/518 |
| 3,915,338 | A | 10/1975 | Kronseder et al. | |
| 4,619,726 | A * | 10/1986 | Cook et al. | 156/366 |
| 4,789,876 | A * | 12/1988 | Miyai et al. | 399/108 |
| 4,884,797 | A | 12/1989 | Svyatsky et al. | |
| 5,029,838 | A | 7/1991 | Kunihiro et al. | |
| 5,053,814 | A | 10/1991 | Takano et al. | |
| 5,181,712 | A * | 1/1993 | Perino | 271/109 |
| 5,607,539 | A * | 3/1997 | Kuppersbusch | 156/364 |
| 6,246,666 | B1 * | 6/2001 | Purcell et al. | 370/221 |
| 6,616,780 | B1 * | 9/2003 | Mahood | 156/60 |
| 2003/0056869 | A1 * | 3/2003 | Tate et al. | 156/64 |

FOREIGN PATENT DOCUMENTS

| | | | |
|---|---|---|---|
| EP | 0259515 | A1 * | 9/1986 |
| EP | 0 259 515 | | 3/1988 |
| EP | 0 345 468 | | 12/1989 |
| EP | 0 941 863 | | 9/1999 |
| EP | 1 491 473 | | 12/2004 |
| EP | 1 495 876 | | 1/2005 |
| JP | 04317929 | A * | 11/1992 |
| JP | 2000168966 | A * | 6/2000 |

OTHER PUBLICATIONS

English translation of JP2000168966A by Sasaki, Jun. 2000.*

Patent Abstracts of Japan, Bd. 2000, No. 10, Nov. 17, 2000 & JP 2000 203725 A (Fuji Photo Film Co Ltd), Jul. 25, 2000.

Patent Abstracts of Japan, Bd. 017, No. 144, Mar. 23, 1993 & JP 2004 317929 A (Canon Inc.), Nov. 9, 1992.

Patent Abstracts of Japan, Bd. 1999, No. 14, Dec. 22, 1999 & JP 11 240628 A (Canon Inc.), Sep. 7, 1999.

* cited by examiner

*Primary Examiner* — Sonya Mazumdar

(74) *Attorney, Agent, or Firm* — Lucas & Mercanti, LLP; Klaus P. Stoffel

(57) ABSTRACT

A device for separating labels (4) or the like stacked in a feeder (2), includes a transport device (6) which draws the labels (4) individually from one end of a stack, and a cassette (1), which holds the extractable labels (4) and which can be removed from the feeder (2) or replaced.

10 Claims, 2 Drawing Sheets

DEVICE FOR SEPARATING LABELS STACKED IN A FEEDER

BACKGROUND OF THE INVENTION

1. Field of the Invention

The present invention relates to a device for separating labels or the like stacked in a feeder, with a transport device for drawing the labels individually from one end of the stack.

2. Description of the Related Art

A device of the type described above on a postage machine is known under the name "JetMail" from Francotyp-Postalia AG & Co. With this device, a strip which can be pulled from a bundle is franked and then glued to an envelopes as it travels by. For this purpose, the bundle of strips is inserted into a shaft and fed from the side to the envelopes as they pass by in a standing position.

SUMMARY OF THE INVENTION

It is the object of the present invention to simplify the processing of labels or the like with a device of the type described above for the purpose of, for example, franking, addressing, or imprinting in some other way, and to improve the reliability of the processing.

This object is met according to the present invention in that a cassette, which can be removed from the feeder, is provided to hold the stacked labels.

A device of this type can be used, for example, as a so-called dispenser of primarily unprinted forms of paper, cardboard, film, etc., for the franking and/or addressing of envelopes, postcards, etc It can be installed upline of a franking or addressing machine or integrated into such a machine. The improper loading of the stacked labels into the magazine of a label-printing device can thus be prevented almost completely, and the readiness or availability of the device can thus be optimized. If the labels are packaged in a cassette, there is no longer any need to exercise special care when inserting them, even if access to the transport device is impeded.

It is advantageous for the feeder to have a magazine to hold the cassette which contains the labels. The same cassette can be refilled with labels by the operator, or the empty cassette can be replaced by a new, full one.

It is advisable for the cassette to have a removal or exit opening located downstream in the takeoff direction of the labels and also an opening assigned to the transport device through which the labels can be drawn off and transported, so that the as-yet unprinted labels can be separated without difficulty.

The exit opening extends transversely to the transport direction with a width equivalent to that of the labels or of the cassette and cooperates with the bottom of the cassette or one of its walls to form a slot-like shape, which has the effect of holding back at least the labels located above the slot.

To accelerate the labels from their stationary position at the end of the stack, the transport device has a driven takeoff roll at the opening to establish friction-locking contact with the labels; this roll grips the labels and draws them from the end of the stack.

The takeoff roll can also be designed to be switchable between two positions, so that it can be raised from the stack when not in operation.

The opening which gives the takeoff roll access is advantageously more-or-less rectangular and is oriented transversely to the transport direction of the labels. The takeoff roll can be provided with a surface coating which promotes frictional contact such as a blend of plastic and rubber.

It has been found to be favorable for the takeoff opening to be located on the bottom of the inserted cassette, so that the stack of labels lies above the takeoff roll.

Alternatively, the takeoff opening can be located on the top of the inserted cassette, in which case the takeoff roll will be located above the stack of labels.

In a preferred exemplary embodiment of the invention, the takeoff opening is on the bottom side of the cassette after the cassette has been inserted into the magazine, that is, the cassette is located above the transport device. Alternatively, the transport device could be located above the cassette, in which case the labels are drawn off by a takeoff roll from the top end of the stack.

Of course, it would be possible for a person skilled in the art to insert a cassette in such a way that the labels could be drawn off vertically or from which vertically oriented labels could be drawn.

It is advisable for the takeoff roll to be installed so that it extends slightly through the takeoff opening into the cassette. This ensures that the labels will be gripped in a friction-locking manner.

To support the takeoff action, a pressure element is proposed, which is located on the side opposite the takeoff opening and which, for example, extends through an opening in the cassette to act on the stack of labels. This pressure element makes sure that the frictional bond between the label and the takeoff roll remains intact.

The cassette for holding labels can be made advantageously of a nonmetallic material such as plastic, paper, cardboard, or plastic sheet.

It is advisable for the takeoff roll to be installed so that it extends slightly through the takeoff opening into the cassette. This can ensure that the labels will be gripped in a friction-locking manner.

If the cassette is made of cardboard or paper, it could be designed as a folding box, which is made from an appropriately precut blank.

The selected feeder could have a transport device transport roll located outside the magazine, downstream from the takeoff roll in the takeoff or transport direction of the labels. This transport roll ensures the continuous transport of the labels after they have been drawn from the stack.

To guarantee that the labels will be separated from each other reliably, a hold-back device is proposed, which is assigned to the transport roll and which acts on the labels projecting through the removal opening of the cassette.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
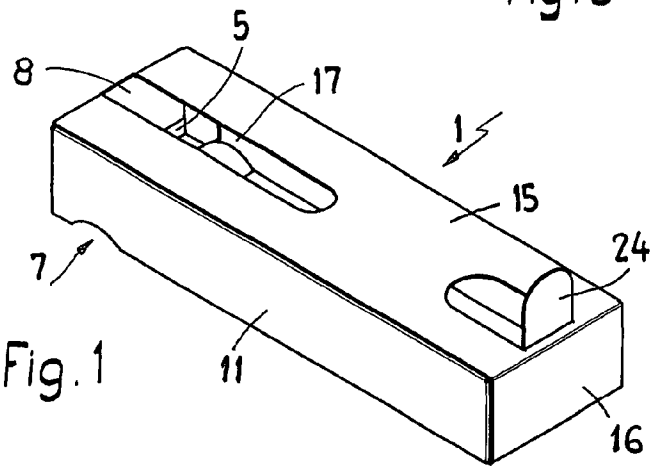
FIG. 1 is a perspective view of an empty cassette for holding stacked or bundled labels, etc.
Figure 4:
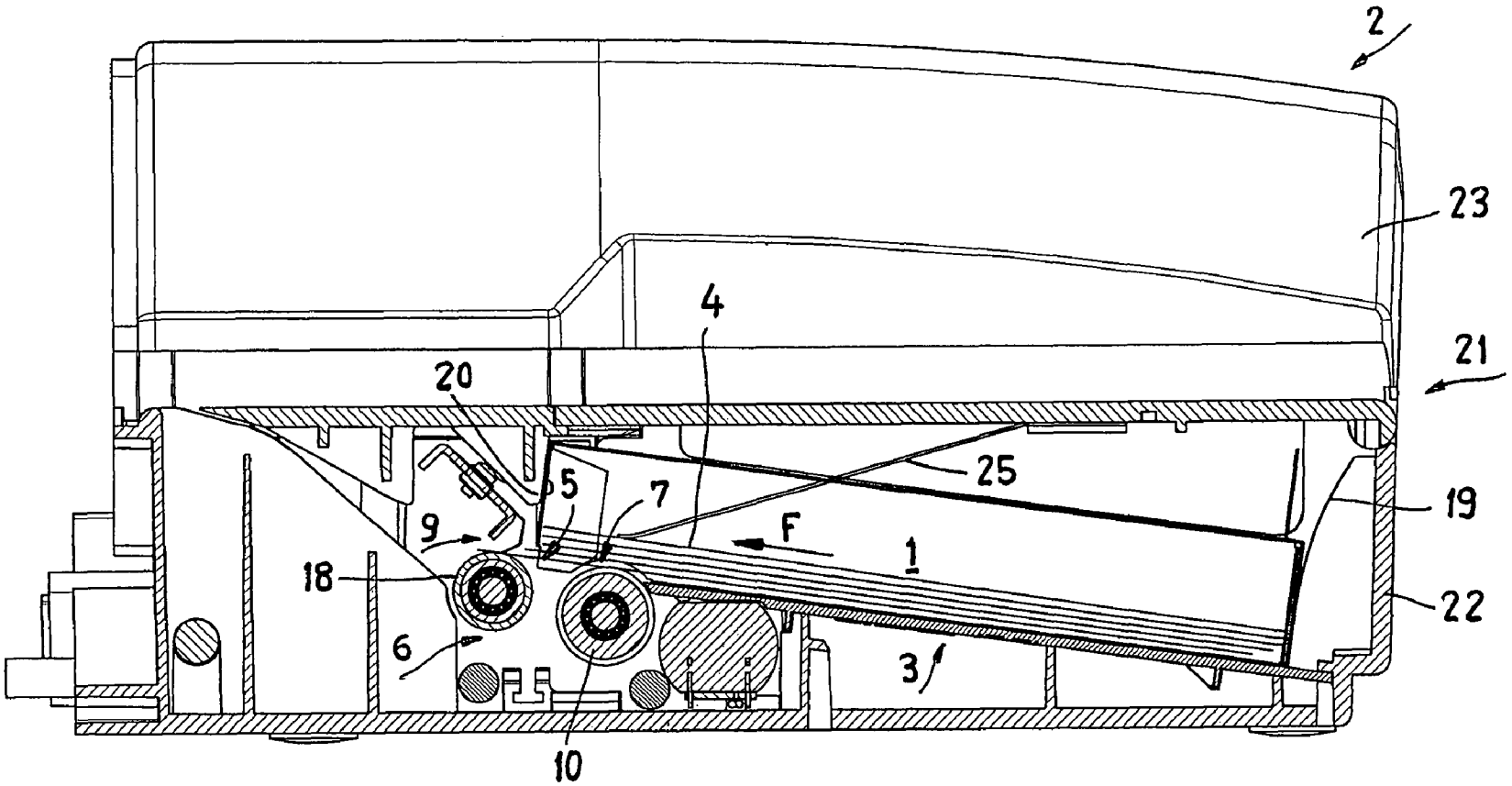
FIG. 4 is a longitudinal cross-sectional view through a feeder with an inserted cassette.

FIG. 1 shows a perspective view of an empty cassette 1, closed on all sides, designed to hold stacked labels 4, coupons, etc, which are stacked on top of each other or which alternatively can be stood up vertically next to each other in the cassette 1. The labels are drawn off individually from one end of the stack. For this purpose, a feeder 2, also called a "feeding board" or "layout board", is provided, as shown in FIG. 4, which draws the labels 4 off individually from the inserted cassette and transports them to a downstream processing station such as a franking machine (not shown in FIG. 4). The cassette 1 can be filled with unprinted labels 4, or it can be filled selectively with labels which have been printed with addresses according to a specific plan or system or simply filled with preaddressed labels.

The feeder 2 has an interior space designed as a magazine 3, into which the cassette 1 is pushed or laid and from which it can be removed again. Alternatively, the magazine 3 could be designed in such a way that the labels in the cassette are removed from the cassette before they are loaded or inserted into the feeder 2. A third possibility is that the cassette 1 with the labels is inserted into the magazine 3, and then the cassette is removed from around the labels, the cassette serving as packaging in both cases.

When a cassette 1 as shown in FIGS. 1-4 is used inside the magazine 3, it has a removal opening 5 located downstream in the takeoff or transport direction "F" of the labels 4, through which opening the labels 4 are drawn or ejected individually from the inserted cassette 1 or from the magazine 3.

The removal opening 5 extends transversely to the takeoff. direction "F" of the labels 4, and its width is equal at least to the width of the labels. It has a narrow, slot-like shape, so that the front wall 8 of the cassette 1, i.e., the wall located downstream with respect to the takeoff direction "F", holds back the partial stack located above the takeoff opening 5. Because of the slight static friction present between the stacked labels 4, it is possible that, when the forward-most or first label 4 is gripped, additional labels 4 on top of or next to it could be carried along through the removal opening 5 or shifted partially from the stack. These additional labels, however, are held back by a hold-back device 9, acting as a stripper, located downstream from the removal opening 5. This retaining device has a free, elastic end, which rests against the transport roll 18.

This process is accomplished by means of a transport device 6 of the feeder 2. A takeoff opening 7 in the cassette 1 for the transport or separation of the labels 4 from the stack is assigned to this transport device. The takeoff opening 7 allows a friction-locking connection to be established between the transport device 6 and the next label 4 in the stack.

The individual labels 4 are transported by the takeoff roll 10 of the transport device 6. This roll projects through or acts through the takeoff opening 7 and rests in a friction-locking manner against the forward-most or next label 4. The takeoff opening 7 is rectangular, and the long sides are oriented transversely to the takeoff direction "F" of the labels 4. The takeoff opening 7 also includes sections in the form of arches or segments of a circle in the two opposing sidewalls 11, 12 of the cassette 1; these sections conform to the shape of the takeoff roll 10. As shown in FIG. 4, the cassette 1 is inserted into the magazine 3 of the feeder 2 in such a way that the labels 4 are drawn off from the bottom of the stack. That is, the takeoff opening 7 and the transport device 6 are located at the bottom of the cassette 1, after it has been inserted into the magazine 3 of the feeder 2. The takeoff roll 10 is installed so that it extends partially into the takeoff opening 7 and thus into the cassette 1. The frictional connection which the takeoff roll 10 makes with the labels 4 could be made adjustable by installing the roll in an appropriate manner. For example, the takeoff roll 10 could be subject to the force of a spring.

The frictional connection could also be designed to be variable or adjusted to maintain a constant value by the use of a pressure element 25, such as a leaf spring or the like, fastened at one end, which would be located on the side opposite the takeoff opening 7 and which would push down on the stack of labels. For this purpose, an opening 17 could be provided in the wall 15, which serves as the cover of the cassette 1.

The cassette 1 is removed from the magazine 3 by the use of a folding tab 24, which is outlined by perforations on the precut blank 13. This tab can be lifted to create a grip by means of which the cassette can be pulled out, or, after the cassette 1 has been at least partially empted, it could be pushed down into the cassette (see FIGS. 1, 3, and 5). The cassette 1 can be made out a nonmetallic, preferably easily deformable material such as plastic, cardboard, paper, or plastic sheet. The cassette 1 could be designed as a folding box, for which purpose cardboard, paper, or plastic sheet would be especially suitable.

Figure 5:
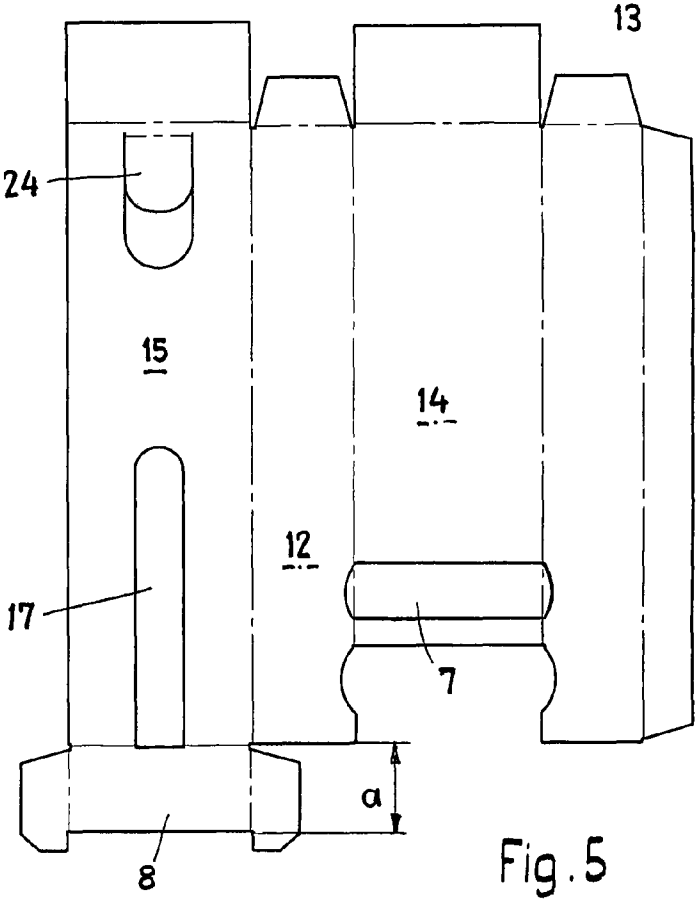
FIG. 5 is a blank precut in accordance with the shape and dimensions of a cassette, so that it can be folded into a cassette.
Figure 2:
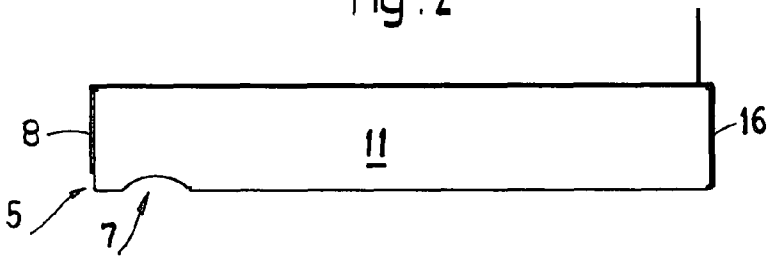
FIG. 2 is a side view of the cassette according to FIG. 1.
Figure 3:
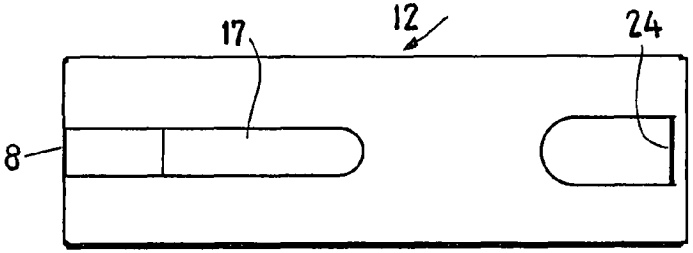
FIG. 3 is a top view of the cassette illustrated in FIGS. 1 and 2.

For this purpose, a precut blank 13, as shown in FIG. 5, could be used. The numbers designating the individual parts of the blank 13 used to form the cassette 1 are the same as those used for the corresponding parts in FIGS. 1-3. The wall assigned to the takeoff opening 7 forms the bottom 14 of the cassette 1, and the section 15 forms the fourth wall. The front wall 8 cooperates with the bottom 14 of the cassette 1 to form the removal opening 5. The height "a" of this end wall is shorter than that of the sidewalls 11, 12 and of the rear wall 16 of the cassette, these three other walls thus being equal to the full height of the cassette 1.

The transport device 6 has a transport roll 18, downstream from the takeoff roll 10 in the transport direction "F" of the drawn-out labels 4. This transport roll is supported outside the magazine 3. A hold-back device 9 is assigned to the transport roll 18, so that only the forward-most label 4 or the label directly adjacent to the takeoff opening 7 is extracted from the cassette 1 or from the magazine 3. The labels are removed in synchrony with the operation of a downstream addressing or franking machine or other type of processing device.

To optimize the frictional connection with the labels 4, the transport and takeoff rolls responsible for their transport are provided with a coating of rubber, for example, which promotes the frictional connection. At the rear of the magazine 3, there is a positioning element 19, illustrated schematically in FIG. 4, which holds the cassette 1 or the stacked labels 4 against a forward stop 20 and thus in the proper operational position.

With this type of positioning and when a cassette 1 is used, the labels 4 are prevented from "walking" as soon as the height of the stack is shorter than the total filling height of the cassette 1 by a retaining element 19, which presses from the rear against the dimensionally stable cassette 1. Problems which negatively affect the transport process can be avoided by a cassette 1.

The way in which the cassette or the magazine 3 and the transport device 6 are arranged in the exemplary embodiment according to FIG. 4 is such that the stacked labels 4 are above the transport device 6 and the cassette 1 or the labels 4 are supplied to the end of the housing 21 which is upstream with respect to the transport direction "F". The housing 21 consists of a base 22, on which the components responsible for the transport and the separation of the labels 4 are mounted or supported, and a hood 23, which protects these components and a control unit (not shown) from outside influences.

By supplying the stack of labels to a packaging device, the labels can be loaded into the cassette 1 while the blank 13 which forms the cassette 1 is being folded into its box-like shape.

Of course, if the cassette 1 has at least one slider-like interior space, which is closed at least at one end, either before loading or after, a cassette 1 can be filled with a prepared stack of labels or with a series of individual labels 4 supplied in the form of, for example, an overlapping stream.

The feeder can be assigned to a franking or addressing machine. In this case, the transport route of a label 4 determined by the transport device 6 can lead downstream to the transport route of flat mail items such as envelopes, postcards, or forms of the franking or addressing machine.

For this purpose, the transport devices are driven synchronously by the feeder and the franking or addressing machine.

The invention claimed is:

1. A device for separating labels (4) stacked in a feeder (2), the device comprising a transport device (6), for drawing the labels (4) individually from one end of the stack, and a cassette (1) configured as a folding box, which can be removed from the feeder (2), for holding the labels (4), wherein the feeder (2) comprises a magazine (3) for holding the cassette (1) filled with labels (4), wherein the cassette (1) has a removal opening (5) cooperating with a bottom of the cassette and located at a front wall of the cassette, which front wall is downstream of a back wall of the cassette in a transport direction (F) of the labels (4), and a takeoff opening (7) in the bottom of the cassette arranged before the removal opening in the transport direction (F), which allows the transport device (6) to draw off the labels (4), wherein the takeoff-opening (7) extends transversely to the transport direction (F) of the labels (4) and has a slot shape with a width equal to a width of the labels, wherein the transport device (6) has a takeoff roll (10) at the takeoff opening (7) for transporting the labels (4) by friction, wherein the openings (5, 7) are rectangular and are oriented transversely to the transport direction (F), wherein, with the cassette being inserted into the magazine (3), the takeoff opening (7) is located at the bottom of the cassette (1), wherein the takeoff roll (10) projects partially through the takeoff opening (7) and into the cassette (1).

2. The device according to claim 1, wherein the cassette (1) is of a nonmetallic material.

3. The device according to claim 2, wherein the nonmetallic material is plastic, cardboard, or paper.

4. The device according to claim 1, wherein the cassette (1.) has a grip, for facilitating the removal thereof from the magazine (3).

5. The device according to claim 1, wherein the feeder (2) is adapted to interact with a processing machine.

6. The device according to claim 5, wherein the processing machine is a franking machine.

7. The device according to claim 6, wherein a transport path of the labels in the feeder (2) leads downstream to a transport path of flat mail items of the franking machine.

8. The device according to claim 1, wherein the pressure element acts on the stack of labels through an opening in a cover of the cassette.

9. The device according to claim 1, wherein the cassette is constructed to be completely closed when inserted into the magazine.

10. The device according to claim 1, wherein the takeoff opening and the removal opening are separated by a portion of the bottom of the cassette.

* * * * *